US006075504A

United States Patent [19]

Stoller

[11] Patent Number: 6,075,504

[45] **Date of Patent: *Jun. 13, 2000**

[54] FLAT PANEL DISPLAY SCREENS AND SYSTEMS

[75] Inventor: Ray A. Stoller, Paulding, Ohio

[73] Assignee: Photonics Systems, Inc., Northwood, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/034,845

[22] Filed: Mar. 19, 1993

[51] Int. Cl.[7] ..... G09G 3/28

[52] U.S. Cl. ..... 345/60; 315/169.4

[58] Field of Search ..... 345/60, 62, 68, 345/72; 313/581–586; 315/169.4

[56] References Cited

U.S. PATENT DOCUMENTS

| | | | |
|---|---|---|---|
| 3,603,836 | 9/1971 | Grier | 313/169.4 |
| 3,701,184 | 10/1972 | Grier | 313/169.4 |
| 3,875,472 | 4/1975 | Schermerhorn | 345/60 |
| 4,820,222 | 4/1989 | Holmberg et al. | 345/60 |
| 4,896,149 | 1/1990 | Buzak et al. | 345/60 |
| 4,924,148 | 5/1990 | Schwartz | 345/60 |
| 5,086,257 | 2/1992 | Gay et al. | 345/68 |
| 5,086,297 | 2/1992 | Miyake et al. | 345/60 |

OTHER PUBLICATIONS

Lawrence E. Tannas, Jr. "Flat–Panel Displays and CRTs", 1985 pp. 369–390.

*Primary Examiner*—Regina Liang
*Attorney, Agent, or Firm*—Marshall & Melhorn

[57] ABSTRACT

A high brightness presentation display system includes:

a transparent display panel having a viewing side and a non-viewing side, furcated row electrode array, furcated column electrode array defining matrix crosspoints and an electro-responsive display producing medium at said matrix crosspoints. Row electrode drive circuitry is connected to selectively drive electrodes in the row electrode array and column electrode drive circuitry is connected to selectively drive electrodes in the column electrode array such that conjoint voltages on selected row and column electrodes operate the display. The furcated electrode spacing and interelectrode spacings are such as to enhance discrimination, and the multiple sub-pixels due to the furcations of electrodes enhance brightness. Optical sensor positioned on the non-viewing side for viewing through the transparent display panel at a predetermined position from the viewing side of the transparent display panel is activated by a remote source producing a control beam of optical energy through the transparent display panel. Optionally, electrically generated icons displayed on the panel can be used to locate the sensors. Color displays and displays having high visibility in sunlight are disclosed.

4 Claims, 6 Drawing Sheets

FLAT PANEL DISPLAY SCREENS AND SYSTEMS

BACKGROUND AND BRIEF DESCRIPTION OF THE INVENTION

This invention relates to generally flat panel display screens and systems, particularly to display systems with enhanced viewing and, still more particularly, to AC plasma display panel (PDP) systems which are particularly adapted for presentation displays and large viewing angle and a display having high visibility in sunlight.

It is common for presentation display systems to incorporate cathode ray tube (CRT) type or projection displays. Such displays have limited viewing angles, reduced brightness and contrast, and are very bulky in large viewing area or screen sizes. Projection-type display systems require space for the projection path, a bulky screen, and the pixels do not have good discrimination ratios. Flat LCD displays have limited viewing angles and are expensive in large sizes. All of these systems are of relatively low brightness and require dimming of room illumination for viewing purposes.

Objects of the present invention are to provide presentation display panels and systems which have high brightness, contrast ratio, wide (up to 160 degrees) viewing angles for comfortable viewing from any place in a room, large picture elements, programmable input or receiver for video presentations with interface that is compatible for multimedia presentations. The display panel can be executive style for mounting on a conference table, wall or stand in meeting rooms, court rooms, classrooms, board rooms, or overhead wall or ceiling mounted for meeting and control centers (conferences, trade/exchanges, transportation centers, command centers, etc.) exposition booths/exhibits, video-conferencing stations, shop floor control, medical stations, virtual instrument stations, and computer integrated manufacturing stations. All sizes are contemplated. The display systems can be of sizes compatible with "pullman" size luggage for air travel. Another object of the invention is to provide flat electronic display panel having high visibility in sunlight.

According to the preferred embodiment of the invention, a flat AC plasma display panel is provided with furcated column and furcated row electrodes with the spacing between furcated elements constituting an electrode being less than the interelectrode spacing constituting the spacing between pixels in both the row and column directions. In such case, each furcated row element furcation crossing each furcated column element furcation defines a discharge site for a sub-pixel. The number of sub-pixels being the product of N row furcations times W column furcations (N×W) which equals one pixel. For color displays having red (R), green (G) and blue (B) channels, the number of sub-pixels is 3 (N×W).

In one preferred embodiment, the display panel is provided with one or more optical sensor means positioned on the non-viewing side of the display panel at one or more predetermined position such that a remotely generated optical beam passes through the panel to enter control signals to modify information on the display. In this embodiment, the display panel is at least partially transparent to the remotely generated optical beam.

In a further preferred embodiment, the drive system for the display causes one or more icons to be presented on said display at the predetermined locations of said optical sensors. The front end of the data handling system is programmable for various video inputs. Binary video logic, gray scale video logic and full color video logic are available options. In one preferred embodiment the furcated row electrodes are spaced apart a distance which is less than the interelectrode space between row electrodes and furcated column electrodes are spaced a distance which is less than the interelectrode spacing, and further the column electrodes are preferably bifurcated and the row electrodes are quadrifurcated.

In a further preferred embodiment, the panel is comprised of plates with a microgrooved dielectric overlying one set of arrays of furcated electrodes with one of the electrode arrays colinear with the microgrooves. For color display, the gas is rich in UV production on discharge and visible light production is low and pairs of UV responsive color phosphor stripes are located on sloping land surfaces forming the grooves in a microgrooved dielectric to further enhance brightness and light output. Note that a monochrome version of this color display structure is provided using all of one color phosphor stripes. A "black and white" monochrome version is provided by using "white" phosphor wherein the white phosphor comprises an appropriate mix of the primary color (red, green, and blue) phosphors. In a further preferred embodiment, each electrode array which is colinear with the microgrooves has one or more furcations aligned with separate grooves so that at least four phosphor stripes are provided for each pixel.

DESCRIPTION OF THE DRAWINGS

The above and other objects, advantages and features of the invention will become more apparent when considered with the following specification and accompanying drawings wherein.

Figure 1A:
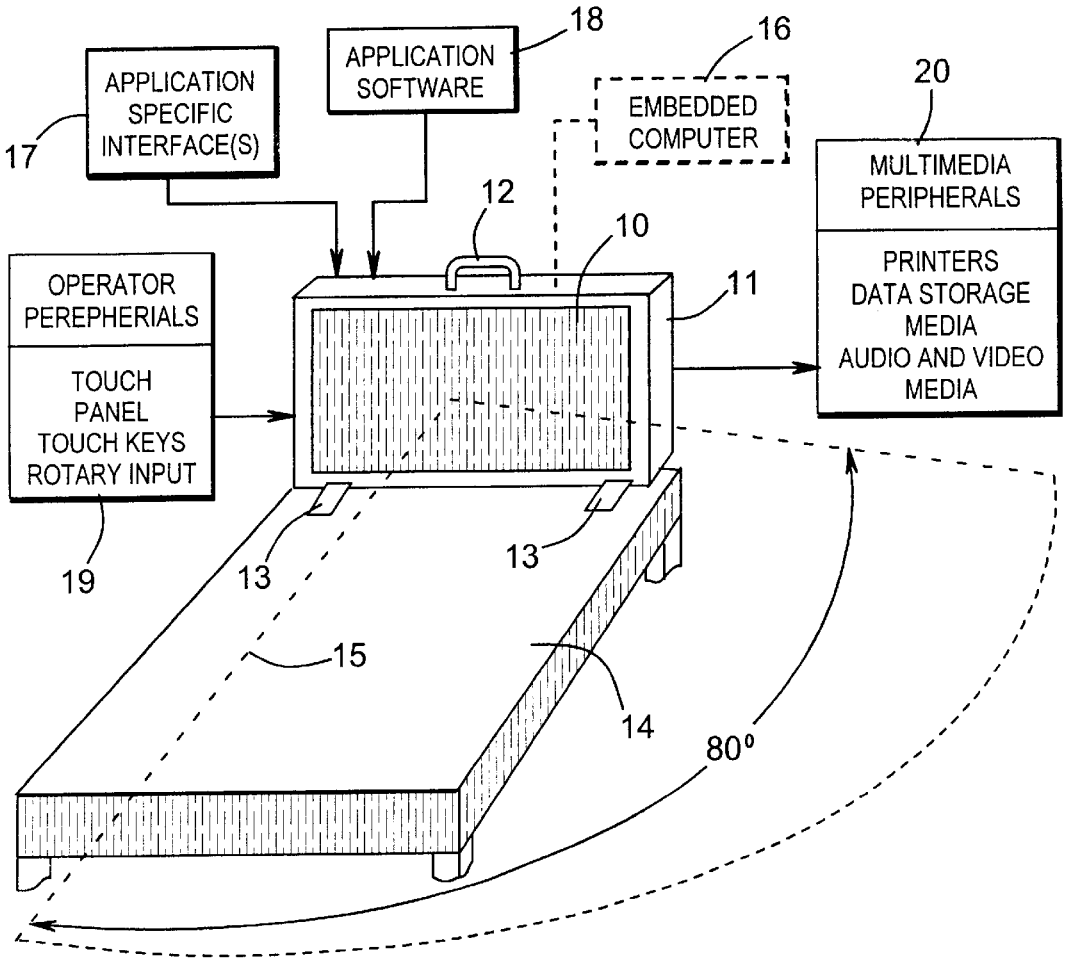
FIG. 1*a* is a schematic diagram of a flat presentation display panel system incorporating the invention, FIG. 1*b

DETAILED DESCRIPTION OF THE INVENTION:

Referring to FIG. 1*a*, a flat display panel 10 (of the matrix type with row and column electrode arrays locating and defining pixel sites) in a luggage style case 11, having optional handle 12 and detachable and optional leg brace brackets 13, is located at one end of a conference table 14.

Figure 1B:
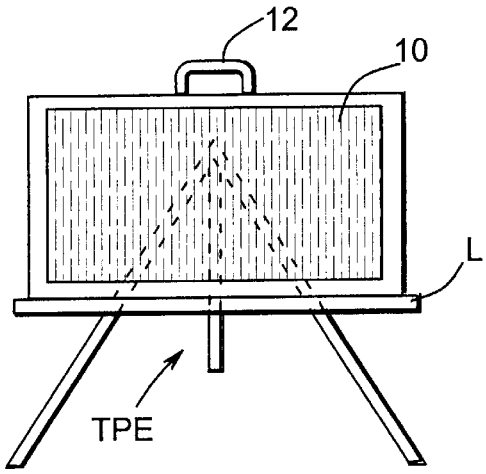
* and FIG. 1*c* illustrates a flat electronic display panel on a tripod easel.

The flat panel display unit 10 could be hung on a wall or from a ceiling or mounted on a tripod easel (FIGS. 1*b* or 1*c*) and has a wide viewing angle (160 degrees or 80 degrees to each side of centerline 15). An embedded computer is subsystem 16 (element "A" in FIGS. 5*a*, 5*b* and 5*c*). The embedded computer 16 is interfaced with electronic drive (element D in FIGS. 5*a*, 5*b* and 5*c*) for the row and column electrode arrays by application of specific interface 17 (elements "B" and "C" in FIGS. 5*a*, 5*b* and 5*c*). Embedded computer 16 is provided with application specific software, indicated diagrammatically at 18 (element "E" in FIGS. 5*a*, 5*b* and 5*c*). The presentation display may also have various operator peripheral input means 19 such as touch panels, touch keys, ball or rotary inputs and, finally, various multimedia peripheral source 20 may be provided for printing displayed material, data storage of material generated during a conference, for example, accessing video material for display and audio material for audio presentation with the visual display.

Figure 2:
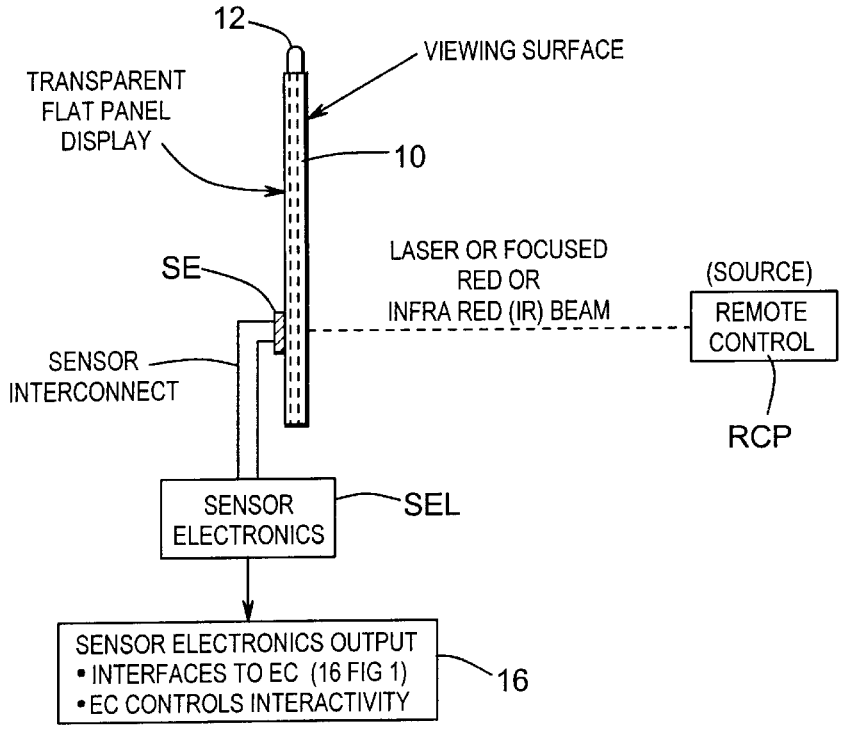
FIG. 2 is a schematic side elevational view of a flat presentation display panel system incorporating the invention.

In a conference or courtroom, etc. environment, it is useful to control the presentation display remotely either by hardwire or, preferably, according to the invention, by remote optical control, and such a system is illustrated in FIG. 2 and described more fully hereafter.

Figure 4:
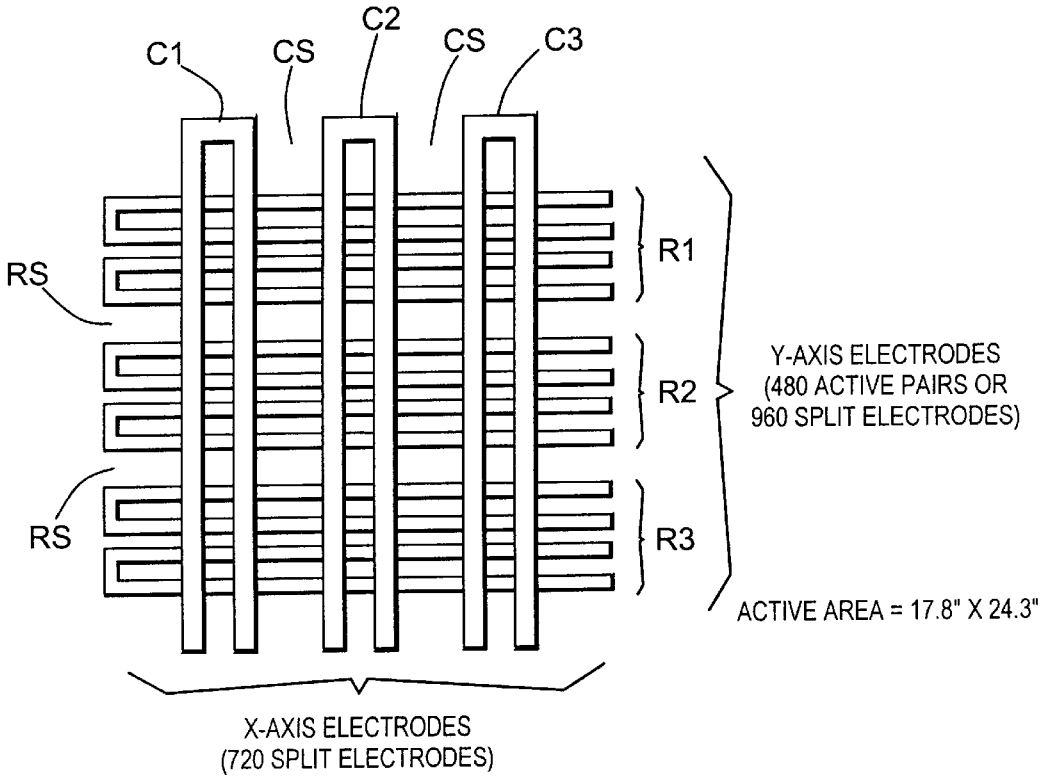
FIG. 4 is an enlarged illustration of exemplary row and column electrode furcation arrangements incorporated in the invention.
Figure 3:
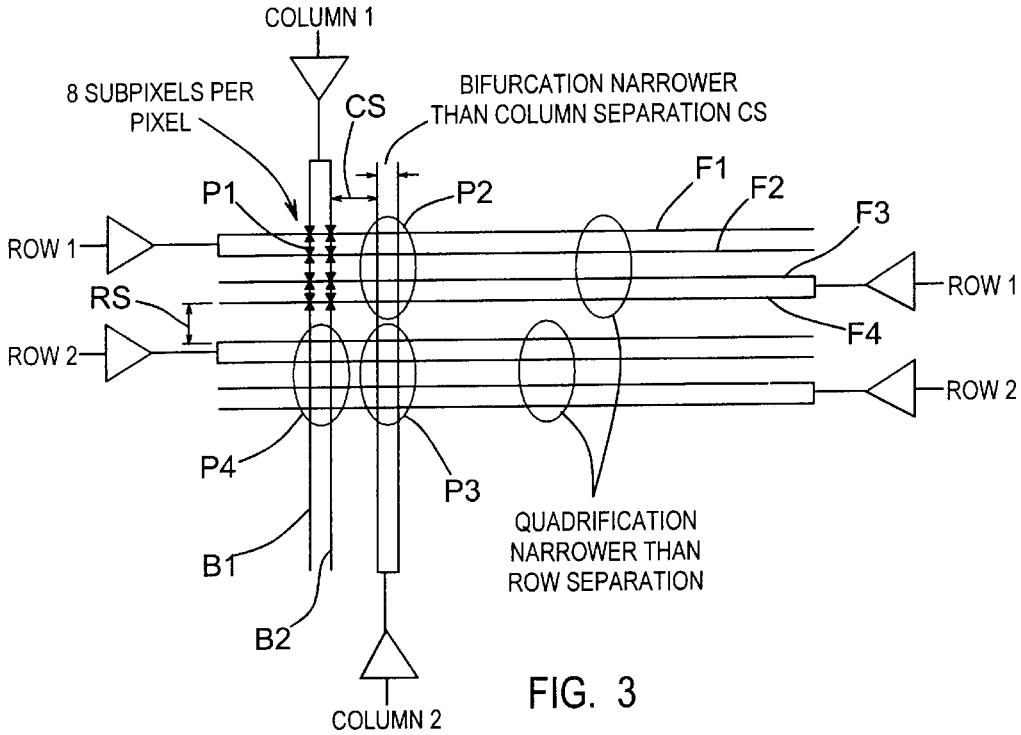
FIG. 3 illustrates the furcated linear row and column electrode arrangement.

FIG. 3 schematically shows 4 full pixels P1, P2, P3, P4, resulting from a 2×2 row×column example in a presentation panel. In FIG. 4 is shown actual electrode features in 3×3 row× column segments in monochrome neon-gas discharge presentation panels in practice of the invention. The electrodes are typically of gold, chrome-copper-chrome or some other metal compatible with thin film deposition and photo etch techniques described in detail in my application Ser. No. 07/932,198 filed Aug. 21, 1992.

In the example of FIG. 3, the 8 sub-pixels comprising a full pixel cumulatively create a very bright gas discharge panel that forms the basis for the presentation panel to be used in conference rooms, court rooms, offices and exhibit halls and the like, where ambient lighting levels are high, especially beyond the range of viewability for projection and CRT presentation systems.

In this example, the row electrodes Row 1, Row 2 are quadrifurcated (F1, F2, F3, F4) and the column electrodes are bifurcated (b1, b2). The row electrode quadrifurcation is narrower than row separation or spacing RS and the column electrode bifurcation is narrower than column separation or spacing CS.

In addition to brighter pixels, the furcated electrodes allow a black background or surrounding blackness to show through when pixels are unlighted and increase pixel contrast. The furcated electrodes provide an effective low impedance multi-path drive consistent with high brightness, wide operating voltage range and good brightness uniformity, while providing the appearance of transparent electrodes normally implemented with ITO or tin oxide in flat panel displays.

The merged (cumulative) brightness of the sub-pixels appears as a uniformly lighted rectangle or square. These blocked pixels give a very distinct, crisp appearance to characters and icons in computer generated video images and are particularly useful in presentation-type displays of this invention. Discrimination of pixels is improved by a distinct, but very small dark line of separation. In fact, discrimination is improved due to both optical and electrical crosstalk reduction inherent in the invention.

Figure 8A:
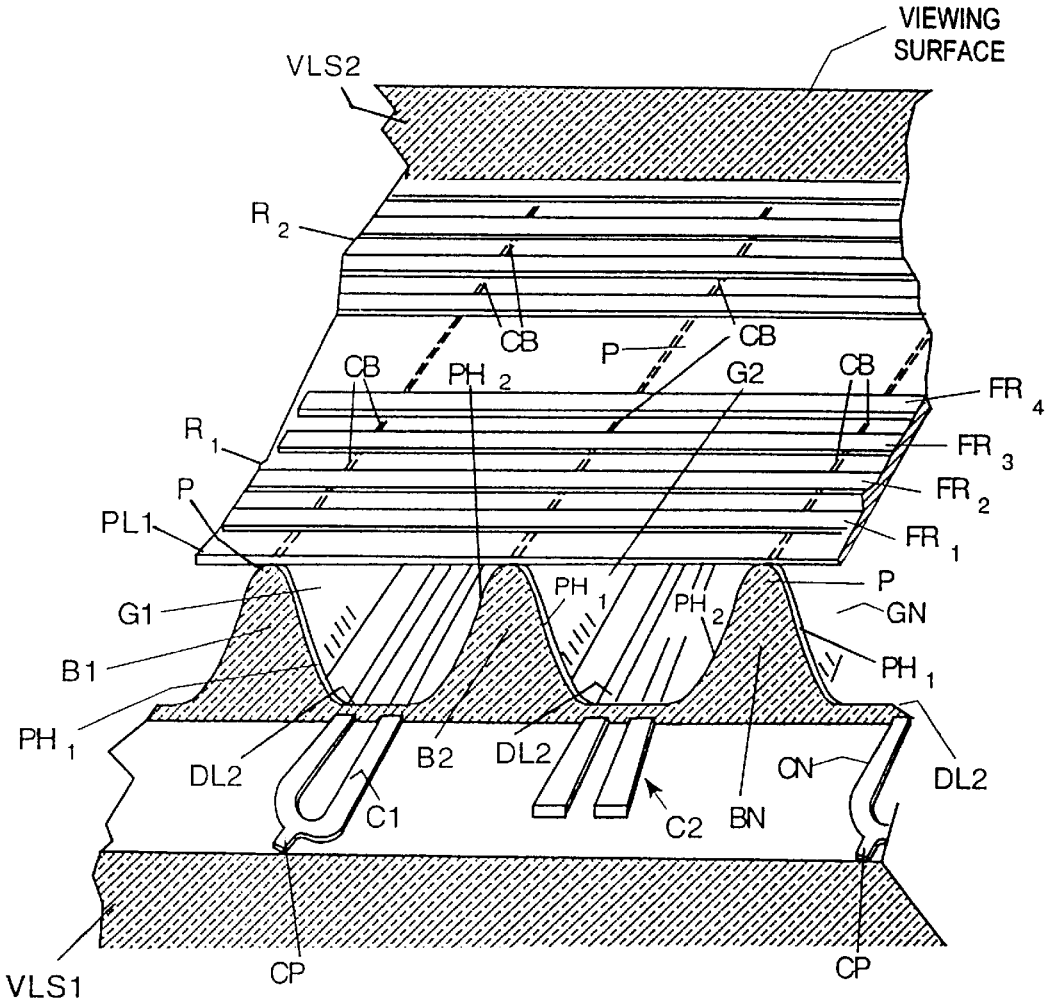
FIG. 8*a* is an enlarged isometric perspective view of a portion of a flat display panel incorporating the invention.
Figure 8B:
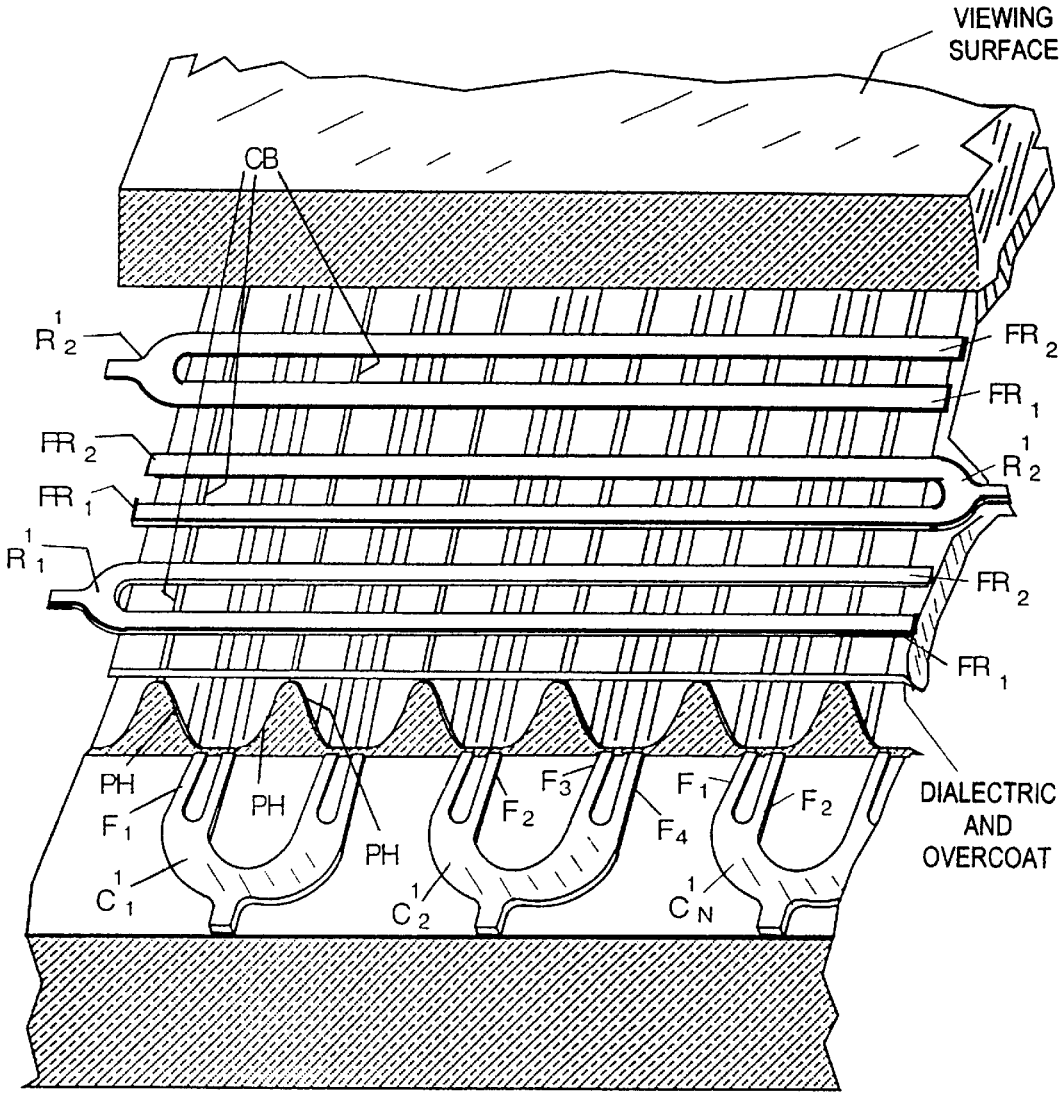
FIG. 8*b* is a further embodiment of the furcated electrode structure.

In another embodiment of the presentation panel of this invention, color phosphors are added along with an internal rib structure as shown in FIGS. 8*a* and 8*b*, and more fully described in my application Ser. No. 07/932,198 filed Aug. 21, 1992. The color phosphors are positioned on the walls of the ribs and provide colored light output when excited by UV from an appropriate gas discharge at the sub-pixels. Referring again to FIG. 3, the preferred embodiment of a color phosphor panel is with column electrodes at the back or non-viewing side, rows on the front or viewing side and the ribs running vertically between columns with photoluminescent phosphors stripes on the ribs at each side of gas-filled channels. Light output comes from photoluminescence of the two phosphor stripes per channel on the walls of the ribs and not from the gas discharge per se. As is known in the art, the gas mixture is chosen to be rich in UV production and very low to non-visible "light" on discharge. In the preferred embodiment, there are 2 phosphor stripes which are excited on either side of the sub-pixel discharges. The colored light outputs from the 2 phosphor stripes merge and are seen as a one colored pixel block, there being three color pixels (RGB) in a full color panel.

As in the non-phosphor embodiment, the sub-pixel matrix creates a very bright cumulative gas discharge, but one in which UV light is not seen by the human eye and which does strongly excite the multiple phosphor stripes in each of the pixels. As in the non-phosphor embodiment, discrimination of full pixels is improved by a distinct, but very small dark line of separation from adjacent full pixels. As noted above, discrimination is improved due to both optical and electrical crosstalk reduction. As in the non-phosphor embodiment, the furcated electrodes allow a black background or surrounding blackness (which can be achieved by adding a black colorant to the dielectric in which the ribs or lands are formed) to show through when pixels are unlighted and increase pixel contrast.

The FIG. 3 scheme is shown for rows and columns interdigitated (e.g. alternate electrodes driven from opposing sides or edges of the panel for the row and column electrodes, respectively) in the panel. It is contemplated that rows and columns may not be interdigitated (see FIG. 4) in presentation panels where the drive electronic interconnect with the panel is compatible with the electrode resolution. In some cases, only the row or column electrodes may be interdigitated.

In FIG. 4, the furcated column electrodes C1, C2, C3 are on 0.0338 inch centers and the furcation spacing is narrower at 0.0128 inch with a spacing of 0.0210 inch between column electrode edges. The row electrodes R1, R2, R3 are quadrifurcated with each furcation being 0.007 inch wide and 0.007 inch spacing between furcations, a center-to-center electrode spacing of 0.0371 inches and electrode edge-to-edge spacing of 0.00161 inches. This results in a display panel having an active area of 17.8"×24.3".

In the non-phosphor embodiment, the row electrodes would typically, but not necessarily, be on the back of the panel, and the front electrodes would be columns. This minimizes front electrode blocking or cover-up of the light output from the discharge as the normal viewing angle varies from side to side.

In the phosphor panel embodiment, the column electrodes would typically, but not necessarily be on the back of the panel, aligned with the channel, groove or trough between ribs or lands. In this embodiment, the columns carry less power than the rows, and would typically be narrower and only bifurcated. This is also consistent with the narrower space available for electrodes between the ribs.

Figure 5:
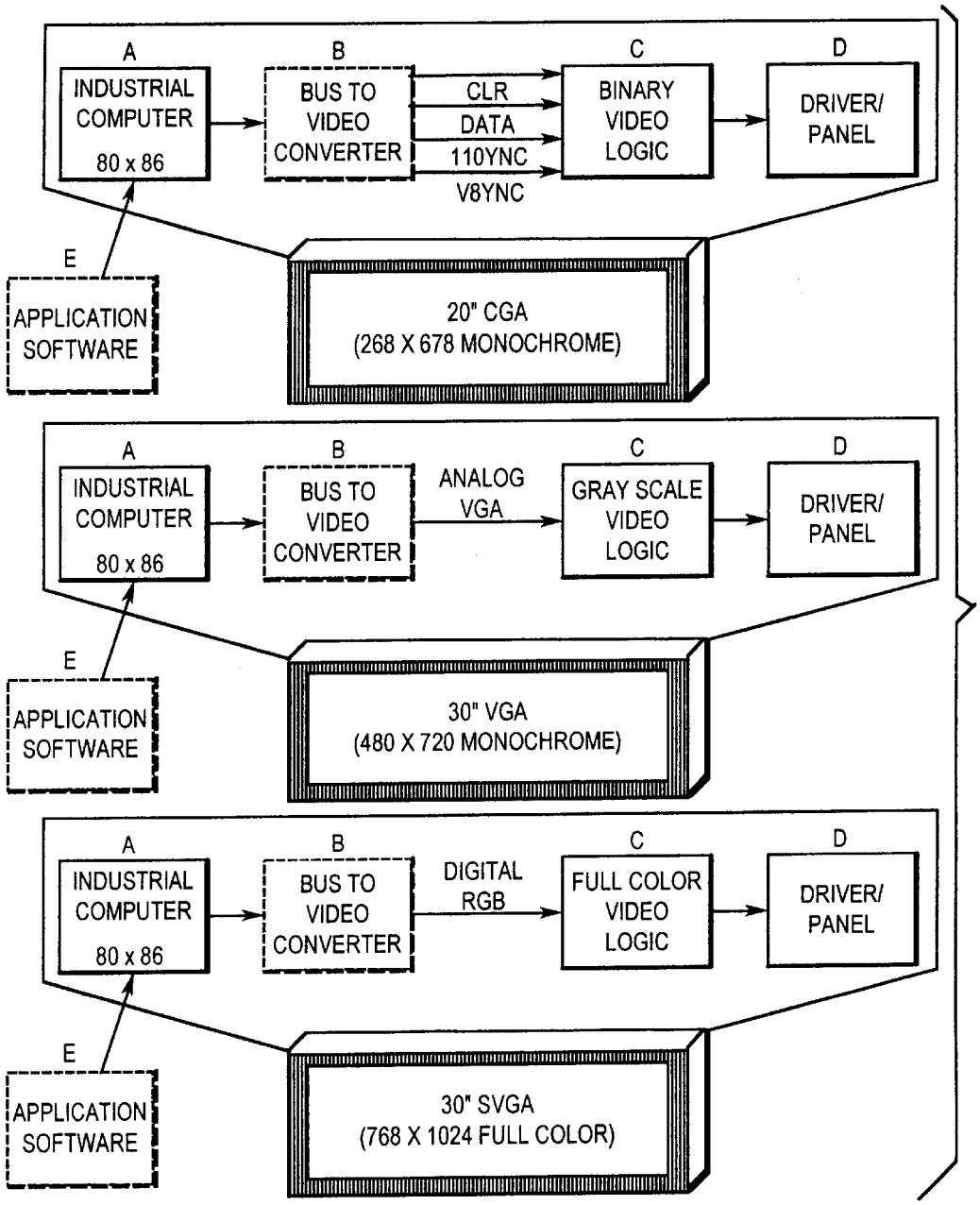
FIGS. 5*a*, 5*b* and 5*c* are schematic block diagrams of various modes of utilizing the invention.

The presentation panel of this invention combines the high brightness, high contrast and wide viewing angle of a thin flat presentation panel together with application specific interface, application software and embedded computer (EC) as shown in FIGS. 5*a*, 5*b* and 5*c*. In one embodiment, the invention as shown in FIG. 1 can be executive style: transportable in luggage-type carrying cases and with feet to allow setting the thin flat screen unit on desk tops or conference tables. There can, of course, be several thin display screens scattered about the room on tripod easels for convenience.

In practice, several types of thin flat panel presentation computer screens allow viewing angles up to 80 degrees from center, and viewing in a radius up to 15 feet away. Larger displays can be formed from edge abutted panels in a parquet or mosaic pattern. Three modes of practicing the invention are shown diagrammatically in FIGS. 5*a*, 5*b* and 5*c*.

One purpose of the presentation panel is to display textual, graphical and iconic information from unusual distances, viewing angles and in normal offices, court rooms, exhibit areas or factory area lighting. The pixels are purposely designed to be "blocky" and distinct from each other when viewed close up to form crisply defined text fonts, charts, line drawings, graphs and icons. For presentation panels, most users do not want pixels to appear as merged together or become "fuzzy" when viewed from a distance.

The ability of a display to present detail is determined by its ability to provide contrast over regions of fine detail in the displayed data. Furthermore, when large screens are designated for group viewing from long distances, the visual acuity of the viewer becomes a significant factor in the legibility of displayed detail. Highest contrast and best visual acuity occur when the pixels are distinctly separated by a dark line.

In projection screens and CRTs, spot size effects cause merging of adjacent spots. In such prior art displays, it has been shown that as viewing distance is increased (while keeping ambient lighting the same), the resolution of the display must be decreased in order for viewers to really see detail. The invention's electrode structure and arrangement in effect physically maintains a small dark separation line between pixels. This improves viewers' visual acuity at a distance, provides high brightness/contrast and distinct pixel outlines. Projection systems and large CRT's cannot achieve the same performance as the plasma display of this invention from the same viewing distances and in the same ambient lighting conditions.

Higher resolution, gray scale and full color may be employed in applications where a combination of the above type of information needs to be presented along with pictorial information. The three modes of practicing the invention illustrated in FIGS. 5*a*, 5*b* and 5*c* represent a progression from lower resolution to higher resolution, as well as gray scale and color. Note that text fonts, charts, etc. can be feature expanded in software to allow greater viewing distances, while maintaining high resolution features for pictorial information. Of course, the resolution features of pictures are also software and hardware adjustable. The gray scale and full color video logic can be performed by the system shown in application Ser. No. 07/626,718 filed Dec. 17, 1990.

The internal components of the flat panel presentation computer comprise four sections which are functionally the same in all embodiments, and differing specifically in accordance with how much function is required for a given type of panel, and the application software and computer power needed.

The video interface between Bus to Video Converter Section B and Binary Video Logic Section C may, in practice, be either analog or digital as best suits cost and availability of commercial hardware in application. Also note that VGA is a subset of RGB video.

Although the computer EC is shown as an industrial computer that is Intel 80×86 based, the EC can be any suitable computer for the application software and application interface requirements. The 80×86 is a preferred embodiment because it represents the family of microprocessors (80286, 80386, 80486 and 80586, etc.) that drive PCAT and higher level PC's heavily used in industry and business.

REMOTE CONTROL

The remote control for the flat panel presentation computer in a preferred embodiment is a red light "laser" pointer which can be easily switched on and off to simulate a point and "click" operation. The EC contains remote control driver software to allow interactivity with the presenter. The stack-up of layers (FIGS. 8*a* and 8*b*), including the channeled or grooved dielectric layers with contrast enhancing black colorant is about 25% transmissive so that infrared light from remote control pointer RCP will shine through to the sensor SE on the non-viewing side of the display panel.

The remote control driver software causes icons to be displayed on the screen at a predetermined location of the optical sensors behind the panel. Other operator peripherals such as touch keys (i.e. touch panels, keyboard, etc.) may be used interactively to cause screen actions. At a predetermined time and/or interactive point in operational sequence, the remote control feature may be invoked. The icons showing on the screen may then be operator selected by pointing and clicking.

Figure 6:
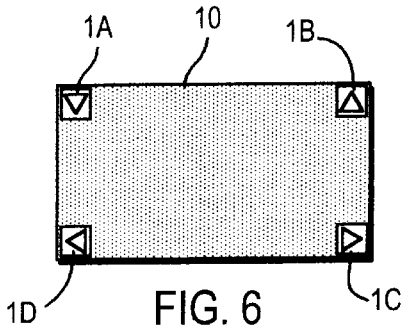
FIG. 6 is a front elevational view of a presentation display panel of the invention showing various icons/sensors at predetermined panel locations.
Figure 7:
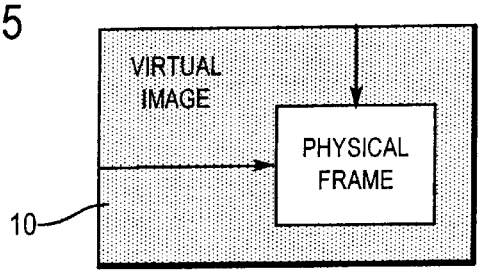
FIG. 7 is a front elevational view of a presentation display showing how the images can be selected.

In a very simple example, icons IA, IB, IC and ID could be shown on the screen 10 in each of four corners as shown in the FIG. 6. Clicking on one of the four direction symbols causes a cursor direction clicked by a predetermined distance for each click. Of course, with appropriately populated and located sensors, a highly tiered and flexible menu-driven presentation can be designed. In another simple example based on the multiple direction icons, clicking on one of them causes the screen's image to scroll or move a predetermined distance in the selected direction for each click.

In the embodiment of FIG. 2, a remote control pointer RCP with high degree of functional capability could be used, such as the remote control for TV sets. Only one sensor SE needs to be embedded in the flat panel presentation computer screen, which senses coded light pulses in serial stream from the pointer RCP. The pointer could incorporate a trackball (not shown), for example, to cause cursor movements on the screen. The sensor electronics SEL is conventional.

Figure 1C:
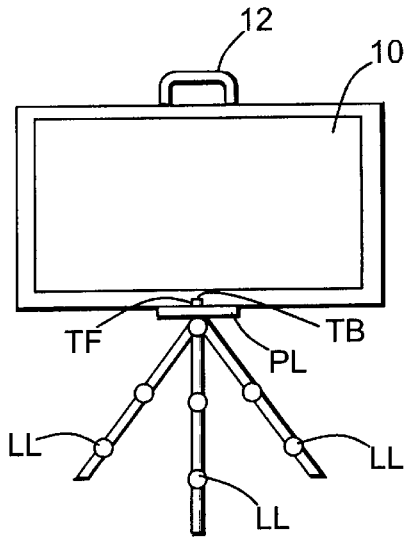

In a court room, for example, during interrogation of a witness about a document, the attorney may use the presentation panel (with a "white" phosphor) of this invention resting on ledge L of a tripod easel TPE to present an electronic version of a document on the presentation panel. Ledge L can be variable in height from the base so the presentation panel height can be adjusted for the most comfortable viewing by an observer. In FIG. 1*c*, the tripod has a conventional platform PL with a threaded fastener TF projecting upwardly for threaded engagement with a threaded bore TB. Tripod legs TL telescope in the usual way and are locked by rotary leg locks LL. Because of the wide viewing angle and high pixel brightness, it is not necessary to dim the court room and for the jury, judge, witnesses and attorneys to bunch together to view the same document.

Several presentation display panels incorporating the invention can be utilized simultaneously. A 30 inch diagonal flat display panels incorporating the invention will present the document sufficiently enlarged for easy viewing by the jury from about 1–15 feet away and any portion of the document can be scrolled into view and enlarged or highlighted for emphasis. As a further example, all of the documentary exhibits, drawings, photographs and the like, that are to be used in a trial can be stored on an CD-ROM disc and selectively and quickly retrieved by a CD-ROM drive for ease of presentation to the witness, jury, and court. Again, any part of a document or exhibit can be electronically enlarged so that, for example, a few lines of text in a document are presented and highlighted for the court and jury. And, the highlighted portion, as well as the entire document can be printed out for use as an exhibit. Instead of one display panel, several can be used for presenting the same material in parallel on the several displays, or, the entire document can be presented on one display panel and enlarged portions can be presented on another presented panel, or several difference documents, drawings, photographs or portions thereof can be selected from the CD-ROM library for substantially simultaneous presentation to the court.

As diagrammatically illustrated in the greatly enlarged isometric view in FIG. 8*a*, bifurcated column electrodes C1, C2, CN on a first non-conductive substrate NCS-1, extend beyond a seal area (not shown) to a connection pad CP on the edge of the substrate. Alternatively, drive signals for the electrodes can be from on-board semiconductor chips as disclosed in my application Ser. No. 07/964,148 filed Oct. 21, 1992 entitled "DISPLAY DEVICE HAVING INTEGRATED CIRCUIT CHIPS THEREON". Dielectric layer DL1 forms a charge storage surface for conventional AC plasma displays and includes a protective and conditioning overcoat, such as one or more layers of MgO. Quadrifurcated row electrodes R1, R2. . . RN. Preferably the column electrodes C1, C2. . . CN are bifurcated and aligned with gas-filled grooves. G1, G2. . . GN formed by lands or barriers B1, B2. . . BN and have a thin dielectric coating DL2 on the electrodes for AC plasma discharge panel type operation. The bifurcated and quadrifurcated electrodes have conductive bridges CB which, preferably, are at regular intervals and aligned with the peaks P of the lands or barriers B. Bifurcated electrodes per se with conductive bridges are known well in the electronic art and disclosed in Grier patents U.S. Pat. No. 3,603,836 and U.S. Pat. No. 3,701,184.

In the present invention, the spacing between each linear row electrode is greater than the spacing between individual furcations of row electrode and the spacing between each linear column electrode is greater than the individual furcations of the column electrodes, and the spacing between linear row electrodes need not be the same as the spacing between linear column electrodes. In the furcated electrode arrangement illustrated in FIG. 8*a*, there are 8 separate and distinct discharge sites forming a given pixel and, with a black dielectric forming the barrier or lands B1, B2 and dielectric DL2 over the column electrodes or a black background in, or behind the non-conductive substrate NCS-1, pixel contrast is increased. The merged brightness of the sub-pixel appears as a uniformly lighted rectangle or square, and are very distinct and crisp in appearance for the presentation displays of this invention.

In FIG. 8*b*, the row electrodes $R'_1$, $R'_2$. . . $R'_N$ are interdigitated (alternate electrodes driven from opposing panel ends while the column electrodes $C'_1$, $C'_2$. . . $C'_N$) are bifurcated in their gas filled channel alignment and further bifurcated in a second adjacent gas channel so that in effect each column electrode is quadrifurcated.

In this case, the phosphors $PH_1$, $PH_2$ can be the same in each adjacent channel or, if a different color is desired, the phosphor stripes can be of different color and combine, with the color of light being determined by the combined light output of the two phosphors and the intensity being set by the gray level.

For monochrome displays, the gaseous medium is one which produces both light and UV, and well known neon gas mixtures typically produce neon orange light. However, monochrome displays are produced in one preferred embodiment by incorporating UV responsive photoluminescent phosphor and gaseous discharge mediums (typically helium based) which, on discharge, are rich in UV production and negligibly low in visible light production. In the preferred embodiment, the sidewalls W1 and W2 on the barriers forming the channels, troughs or grooves have photoluminescent phosphor stripes PH1 and PH2 thereon. These phosphor stripes are sandwiched between thin protective layers such as MgO, and produce substantially more visible light.

In a further embodiment, a direct view display panel having high visibility in sunlight is provided wherein the photoluminescent phosphor stripes PH1, PH2 are phosphors which emit green visible light at about 200 foot lamberts or greater. One preferred phosphor is zinc silicate, manganese activated ($Zn_2SiO_4$:Mn).

Specific phosphors which emit green visible light include magnesium gallate activated with divalent manganese; zinc silicate activated with divalent manganese (see formula above); zinc-cadmium sulfide activated with zinc or silver; and zinc cadmium borate (can be modified with gallium oxide) activated with trivalent terbium. For color displays the phosphor on a triad of channel or trough walls would emit red, green and blue light with each color channel being gray scale.

Some specific examples of phosphors which emit red visible light include magnesium germanium activated with divalent manganese; magnesium fluorogermanate activated with divalent manganese; aluminum oxide activated with rhodium; aluminum oxide activated with chromium; zinc cadmium sulfide activated with copper or silver; cadmium borate activated with divalent manganese; magnesium titanate activated with divalent manganese; calcium orthophosphate activated with tin in the stannous state and zinc selenide or zinc cadmium selenide activated with copper.

Specific phosphors which emit blue visible light include a host matrix of strontium phosphate activated with ytterbium; zinc sulfide activated with zinc or silver; calcium oxide and tungsten oxide activated with lead; and cadmium tungstate activated with uranium.

The multiple sub-pixel discharges in each trough or channel constitute a very rich UV source for each color channel, so that with the level phosphor stripe per groove or channel for a given "pixel" in a display in the embodiment in FIG. 8*a*, there are 24 sub-pixel discharges (8 per color channel) making for a very bright color display such that dimming of room lighting is not required. Moreover, with the black background discussed above, the pixel contrast is increased.

In the embodiment shown in FIG. 8*b*, two or more grooves, channels or troughs constitute a single column electrode and in such case higher brightness is achieved by virtue of the use of a multiple of phosphor stripes 2XN where N is the number of grooves, channels or troughs included in a row or column electrode.

While preferred embodiments of the invention have been shown and described, it will be appreciated that various adaptations and changes will be obvious to those skilled in the art.

What is claimed is:

1. A high brightness AC plasma display device comprising:

a) a first substrate having a first array of linear electrodes thereon, each electrode in said first array of linear electrodes being constituted by a plurality of parallel furcations connected to a common source of operating potentials, b) a first dielectric layer on said first array of linear electrodes, c) a plurality of linear non-conductive barriers formed in spaced array on said first dielectric layer and parallel to said plurality of parallel furcations, to define a plurality of discharge channels aligned with said linear electrode array, there being at least two discharge channels for each electrode in said first array of linear electrodes and at least one furcation of an electrode aligned with each said at least two discharge channels, respectively, d) each said linear non-conductive barriers having pairs of phosphor wall surfaces which are at an angle to said first substrate, there being at least four said wall surfaces for each electrode in said first array of linear electrodes, e) a UV responsive photoluminescent phosphor stripe on each of said wall surfaces, respectively, f) a second substrate having a second linear electrode array thereon and arranged transversely to said first array of linear electrodes to define a matrix of pixel sites, g) a second dielectric layer on said second linear electrode array, h) seal means joining said substrates together, and i) a gas medium filling said channels and sealed therein by said seal means, said gas medium producing UV light on discharge by application of operating potentials to selected electrodes in said first and second linear electrode arrays, respectively.

2. The high brightness AC plasma display device defined in claim 1 wherein the electrode in said second linear electrode array are furcated such that each crossing of a first electrode array furcation by a furcation in an electrode in said second electrode array defines a sub-pixel which upon discharge creates UV for exciting a portion of a pair of said phosphor stripes adjacent thereto for said sub-pixels.

3. The high brightness AC plasma display device defined in claim 1 wherein each said phosphor stripe is comprised of a green light emitting phosphor.

4. The high brightness AC plasma display device defined in claim 1 wherein said phosphor stripes are comprised of alternating blue, green, and red light emitting phosphors, respectively.

* * * * *